United States Patent [19]

Combs

[11] 4,375,589

[45] Mar. 1, 1983

[54] DIESEL FUEL TANK HAVING REMOVABLE ELECTRIC IMMERSION HEATER ASSEMBLY

[75] Inventor: Elmer M. Combs, Rock Springs, Wyo.

[73] Assignee: B & C Enterprises, Green River, Wyo.

[21] Appl. No.: 191,309

[22] Filed: Sep. 26, 1980

[51] Int. Cl.[3] ..... H05B 3/82; F24H 1/20; F02N 17/04

[52] U.S. Cl. ..... 219/315; 123/142.5 E; 219/205; 219/208; 219/336; 219/338; 219/523; 219/534; 219/552

[58] Field of Search ..... 219/315, 205–208, 219/202, 312, 310, 313–316, 318, 335–338, 523, 552, 534; 123/142.5 E, 142.5 R

[56] References Cited

U.S. PATENT DOCUMENTS

| | | | |
|---|---|---|---|
| 411,737 | 9/1889 | Smith | 219/315 |
| 849,368 | 4/1907 | Christian | 219/313 |
| 1,158,539 | 11/1915 | Newcomb | 219/523 X |
| 1,569,810 | 1/1926 | Johnson | 219/315 |
| 1,662,555 | 3/1928 | Wojciechowski | 219/318 X |
| 1,723,743 | 8/1929 | Mason | 219/552 X |
| 1,770,642 | 7/1930 | Gelimo | 219/552 X |
| 2,150,762 | 3/1939 | Edwards et al. | 219/336 X |
| 3,674,985 | 7/1972 | Ragault | 219/336 X |

FOREIGN PATENT DOCUMENTS

| | | | |
|---|---|---|---|
| 1305731 | 8/1962 | France | 219/315 |

*Primary Examiner*—A. Bartis

*Attorney, Agent, or Firm*—Harvey B. Jacobson

[57] ABSTRACT

A diesel fuel tank has an opening in the top wall through which an electric immersion heater assembly is inserted into the tank to heat the contents thereof. The immersion heater assembly includes an outer tubular member arranged vertically in the tank and having an open upper end sealingly secured in the tank opening and a closed lower end near the bottom of the tank. An inner tubular member of slightly smaller diameter than the outer member and of a length coextensive with a major portion of the length of the outer member is removably inserted into the outer member through the open end thereof. A double filament DC light bulb mounted on the lower end of the inner member serves as an electric heating element located in the lower portion of the outer member. Air heated by the light bulb flows upwardly by convection into the narrow circumferential space between the inner and outer members thereby assuring that the entire length of the outer member in contact with the diesel fuel in the tank is heated. The inner tubular member is filled with silicone resin heat insulation to retard accumulation of heat within the inner member.

4 Claims, 4 Drawing Figures

DIESEL FUEL TANK HAVING REMOVABLE ELECTRIC IMMERSION HEATER ASSEMBLY

BACKGROUND OF THE INVENTION

1. Field of the Invention

The present invention relates to immersible heaters and more particularly pertains to an immersible heater for use in a diesel fuel tank which includes a pair a concentrically aligned tubular members having a cylindrical space defined therebetween so as to provide for efficient heat circulation within the diesel fuel tank.

2. Description of the Prior Art

With respect to the development of immersible heaters, it has been the general practice to utilize only a single tubular member which is insertable in a fluid, such tubular member having a heating element positioned therein whereby heat accumulating inside the tubular member may be conducted through the walls thereof into the surrounding fluid to heat the same.

In this respect, U.S. Pat. No. 1,723,743, issued Aug. 6, 1929, to Mason, is illustrative of the state of the art with regard to prior art immersible heaters. The Mason heater consists of a single tubular member which is fluid-tight and which is insertable into a tank containing a fluid so that the fluid is in contact with an outer surface of the tubular member. A light bulb is then suspended on an electric cord down into the tubular member so as to heat the air therein, such heat being conducted through the walls of the tubular member into the surrounding fluid. This construction presents a number of problems in that the light bulb may be easily broken during insertion or removal from the tubular member since no rigid structure is provided to control the movement of the light bulb within the tubular member. In other words, the light bulb is free to swing back and forth upon the electrical cord from which it is suspended, and since the Mason device utilizes AC current, there is an extreme danger of electrical shock involved. Further, the tubular member of Mason must necessarily be of a large diameter so as to provide sufficient space for the insertion or removal of the light bulb serving as the heating element. As such, a large volume of air is present within the tubular member and a large loss of efficiency results since much of the provided heat will never be directed into direct contact with the inner surface walls of the tubular member so as to be conductibly transferred into the surrounding fluid. In other words, only that portion of heated air coming into direct contact with the inner surface walls of the tubular member will effect a transfer of heat into the surrounding fluid, and much of the heat contained within the tubular member which might otherwise be conducted into the fluid will never come into contact with the inner surface walls due to the large amount of wasted spaced within the member. As such, those concerned with the development of immersible heaters have long recognized the need for designing a more efficient means of transferring the heat from a heating element within a tubular member to a surrounding fluid.

The problem of efficient heat transfer from an immersible heater to a surrounding fluid is particularly acute with regard to diesel fuel containers. In this regard, diesel fuel tends to gel in cold climates and as such, there exists a real need for the use of immersible heaters. However, a problem of safety exists in that it is desirable that a very closely controlled heating of the diesel fuel be provided, since excessive heating may result in a combustion of the fuel. It can be appreciated that the Mason heater, as above described, could not efficiently be used as a diesel fuel heater since a controlled heating of the diesel fuel is not possible. This is true due to the fact that the interior of the Mason heater is not designed to selectively circulate heated air in a manner which would permit an operator to accurately estimate the amount of heat being conducted from the heater into the diesel fuel.

SUMMARY OF THE INVENTION

The general purpose of the present invention, which will be described subsequently in greater detail, is to provide an immersible heater that has all of the advantages of similarly employed prior art devices and has none of the above described disadvantages. To attain this, the present invention has been designed for use as a diesel fuel heater and makes use of two concentrically mounted tubular members which have defined between them a narrow cylindrical space whereby heated air may travel through the space in a manner which assures direct contact with the inner surface of the outer tubular member to thereby promote transfer of the heat into a surrounding fluid. Specifically, an inner tubular member is provided with a light bulb on an end thereof, such light bulb receiving power from a DC current source directed through the inner tubular member, and the inner tubular member is then insertable into an outer tubular member already immersed within a diesel fuel tank. The inner tubular member has its interior space portion filled with silicone which operates as a heat insulator, and once the inner tubular member has been inserted into the outer tubular member, the light bulb is positioned within a narrow space proximate to the end of the outer tubular member extending into the diesel fuel. As such, the air heated as a result of the light bulb having power supplied thereto flows upwardly into the narrow space between the inner and outer tubular members thereby assuring that much of the heat generated will contact the inner surface wall of the outer tubular member to facilitate a transfer therethrough and subsequent heating of the diesel fuel.

It is therefore an object of the present invention to provide an immersible fuel tank heater which has all of the advantages of the prior art devices and none of the disadvantages.

It is another object of the present invention to provide an immersible fuel tank heater which may be easily and economically manufactured.

It is a further object of the present invention to provide an immersible fuel tank heater which efficiently conducts heat to a surrounding fluid.

It is still another object of the present invention to provide an immersible fuel tank heater which utilizes a light bulb as a heating element and which provides an efficient means of inserting and removing said light bulb from a surrounding fluid in a manner which will prevent a breaking of the light bulb.

It is yet another object of the present invention to provide an immersible fuel tank heater which utilizes a light bulb as a heating element and which need not be completely removed from a fuel tank during an exchanging of the light bulb.

It is even a further object of the present invention to provide an immersible fuel tank heater which is especially designed for use in a diesel fuel tank.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
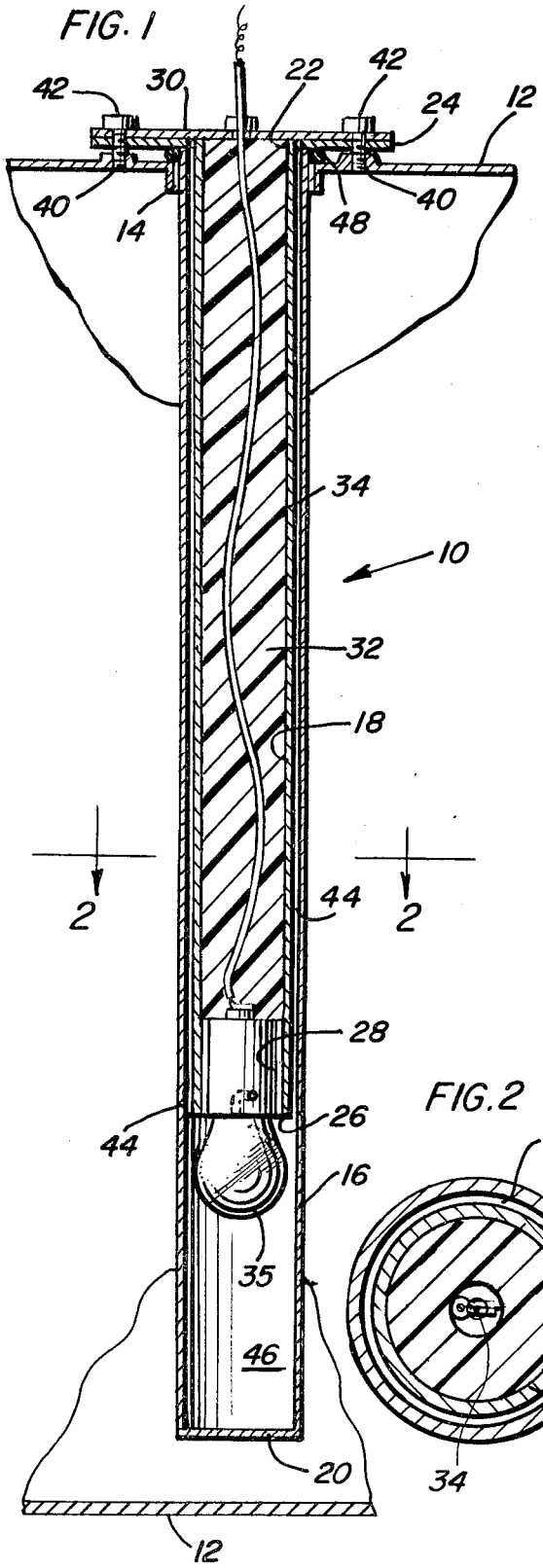
FIG. 1 is a side elevation view, partly in cross section, of the present invention.

Reference is made to FIG. 1 which illustrates the diesel fuel tank heater 10 of this invention inserted into a diesel fuel tank 12 through a flanged opening 14. The diesel fuel tank heater 10 can be variable in length so as to extend from a topmost portion of a diesel fuel tank 12 to its bottommost portion, thereby at all times being in heating contact with whatever amount of fuel is contained within the tank. The tank heater 10 includes an outermost or exterior hollow tube 16 and an innermost or interior hollow tube 18. The outermost tube 16 is sealed at one end by a circular wall portion 20 and is open at its other end so as to present an opening 22 through which the innermost tube 18 is insertable. The open end 22 of the exterior tube 16 has a flange 24 concentrically aligned with and fixedly mounted thereto so as to provide a connection means for attaching the outermost tube to the diesel fuel tank 12.

As clearly illustrated in FIG. 1, the innermost tube 18 has a first open end 26 into which is positionable an electric bulb socket 28. The innermost tube 18 further includes a circular plate flange member 30 which is fixedly secured to a second end of the tube and which is designed for attachment to the flange 24 and the diesel fuel tank 12. In this regard, the circular plate flange member 30 serves to effectively seal one end of the innermost hollow tube 18, while the electric bulb socket 28 serves to effectively seal the other end. As such, the interior hollow space contained within the innermost hollow tube 18 and as defined by the circular flange plate member 30 and the electric bulb socket 28 is filled with silicone 32 which serves as a heat insulation means and which further serves to prevent excessive movement of an electric wire 34 contained therein. In this regard, the electric wire 34 is connected to the electric bulb socket 28 and is routed through the silicone 32 and thence outwardly through the circular plate flange member 30 to a source of electrical power so as to selectively light a light bulb 35 mounted in the electric bulb socket. Of course the prevention of excessive movement of the electric wire 34 prevents a fatigue breaking of the same within the innermost hollow tube 18 which would result in the diesel fuel tank heater 10 becoming inoperative.

Figure 3:
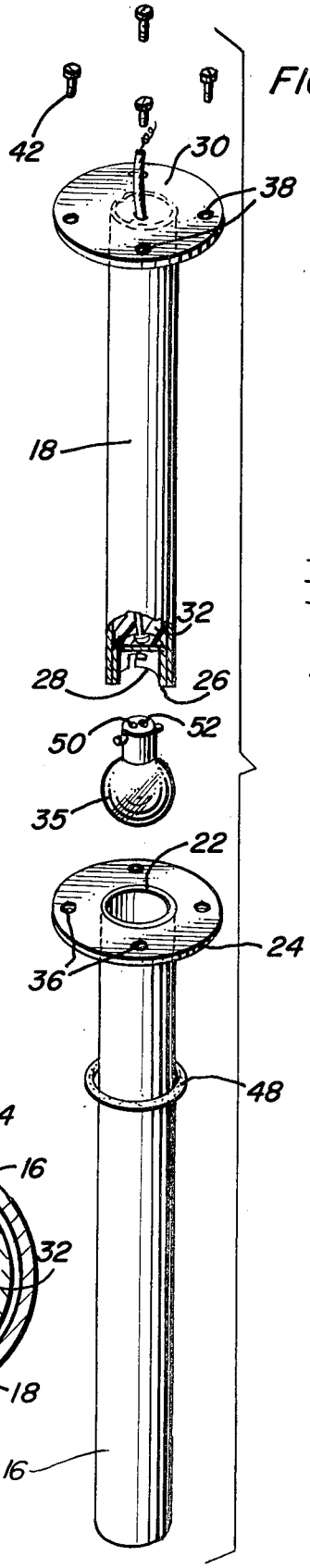
FIG. 3 is an exploded group perspective view, partly in section, illustrating the disassembled construction of the present invention.

As can be appreciated with simultaneous reference to both FIGS. 1 and 3, the flange 24 is provided with a plurality of apertures 36 and the flange member 30 is provided with a plurality of apertures 38. These apertures 36, 38 are concentrically alignable with each other and are further concentrically alignable with a plurality of apertures 40 contained on the diesel fuel tank 12 whereby attachment means, such as bolts 42, may be utilized to connect the fuel tank heater 10 to the diesel fuel tank in the manner illustrated. As such, the positioning of these apertures 36, 38 permit the concentric mounting and positioning of the innermost hollow tube 18 within the outermost hollow tube 16.

Figure 2:
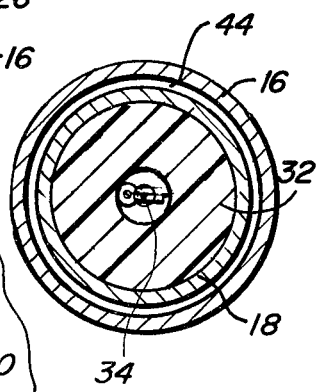
FIG. 2 is a transverse sectional view taken substantially along section line 2—2 on FIG. 1.

Of particular significance with regard to the present invention is the provision of the cylindrical space 44 provided between the outermost wall of the interior hollow tube 18 and the innermost wall of the exterior hollow tube 16. In this regard, in FIG. 2 it can be seen that the space 44 exists substantially over the entire length of the innermost hollow tube 18, as well as around the entire circumference thereof. Accordingly, heat which is generated by the light bulb 35 accumulates within the space 46 located proximate to the bulb 35 and then is circulated upwardly through the fuel tank heater 10 through circumferential space 44. Due to the narrowness of the circumferential space 44, a high efficiency heat transfer is afforded between the space and the interior wall of the outermost hollow tube 16. In that the interior hollow tube 18 is filled with silicone, not much heat is conducted inwardly into the innermost hollow tube and as such, even more heat is available for transfer into the surrounding diesel fuel.

Referring again to FIG. 3, it can be appreciated that the outermost or exterior hollow tube 16 may be sealingly attached to a diesel fuel tank 12 through the use of an O-ring 48 positionable thereover and serving as a seal between the flange 24 and an exterior surface of the fuel tank. It can be further appreciated then with reference to FIG. 3 that that innermost or interior hollow tube 18 may be withdrawn from the exterior hollow tube 16 in the manner illustrated so as to permit replacement of the light bulb 35. The innermost tube 18 permits an extraction of the light bulb 35 out of the outermost tube 16 in a manner which prevents a breaking thereof since the bulb is of a lesser diameter than the outside diameter of the innermost tube thereby preventing an engagement of the bulb with the inner surface of the outermost tube 16. Further, this construction eliminates any spillage of diesel fuel during replacement of the light bulb 35 since the outermost hollow tube 16 need not be withdrawn from the diesel fuel during bulb replacement. Further illustrated in FIG. 3 is the fact that the light bulb 35 is preferably of a double filament construction whereby two contacts 50, 52 may be provided so that in the event one of the filaments should break, a second filament would continue to burn and heat the diesel fuel.

Figure 4:
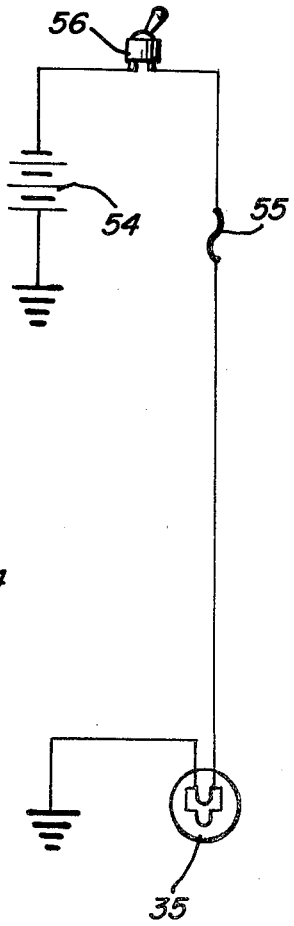
FIG. 4 is a schematic of the DC electrical circuit utilizable to power the immersible heater forming the present invention.

Lastly, FIG. 4 illustrates that the present invention utilizes a DC source of electricity, such as battery 54 normally used in various vehicles and equipment employing diesel fuel consuming engines, such battery being directly connected to the electric bulb 35, while the electric circuit associated therewith may be further provided with a fuse 55 and an externally mounted switch 56 so as to permit selective energizing of the diesel fuel tank heater 10. Of course, it should be realized that alternatively an AC power source may be provided to effect an operation of the fuel tank heater 10. In this respect, the present invention could assume many different forms while still employing its inner and outer tubular construction. As such, optimum dimensional relationships for the parts of the invention are deemed readily apparent and obvious to one skilled in the art, and all equivalent relationships to those illustrated in the drawings and described in the specification are intended to be encompassed by the invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a material holding tank having an opening in the top surface thereof, an immersion heater insertable through said opening for immersion in the material contained in said tank, said heater comprising an elongated heat conduction means in contact with the material to be heated and extending generally vertically across substantially the entire height of the tank from said top surface to the bottommost portion of the tank, an electric heating element positioned within the heat conduction means and serving as a source of heat to be transferred to the material to effect a heating thereof, said heat conduction means including an elongated outer tubular member of cylindrical configuration and having an open upper end and a closed lower end, the upper end of said outer tubular member being sealingly secured in said opening with the open end thereof opening outwardly of the tank, said heat conduction means further including an inner tubular member of cylindrical configuration coextensive in length with a major portion of the length of the outer tubular member and coaxially removably inserted within the outer tubular member through said open end thereof, said inner tubular member having an outer diameter slightly smaller than the inner diameter of said outer tubular member and a lower end spaced from the closed end of the outer tubular member, said heating element being fixedly secured to the lower end of said inner tubular member and extending into space between said lower end and said closed end, respectively, of said inner and outer tubular members, heat flow control means comprising an air filled, narrow, cylindrical space between the outer tubular member and the inner tubular member extending substantially throughout the entire length of the inner tubular member as well as around the entire circumference thereof adapted to receive therein by convective circulation heat generated by the heating element so conduction by a highly efficient heat transfer is afforded from said outer tubular member of the heat conduction means throughout essentially the entire length thereof to the material, an electric wire directed through an interior portion of the inner tubular member and connected at one end thereof to the heating element and extending outwardly through a circular plate flanged member secured to and closing the other end of said inner tubular member for connection with a source of electrical energy, the inner tubular member of said conduction means comprising an electrical return path for connection with the source of electrical energy connected to the heating element, and heat insulation material essentially filling the inner tubular member throughout and being of a low heat capacity thereby augmenting maximal heat transfer from the heat conduction means to the material to be heated.

2. The combination as defined in claim 1, wherein said heating element comprises an electric light bulb.

3. The combination as defined in claim 1, wherein the material to be heated is diesel fuel.

4. The combination as defined in claim 1, wherein the heat insulation material is a silicone resin and prevents excessive movement of the electric wire within the inner tubular member and wherein the heating element is a double filament light bulb having two filaments connected in parallel to the source of electrical energy such that in the event one of the filaments becomes inoperative, the other filament continues to heat the material to be heated.

* * * * *